US005994887A

United States Patent [19]

Tokuda

[11] Patent Number: 5,994,887

[45] Date of Patent: Nov. 30, 1999

[54] LOW POWER CONSUMPTION CONSTANT-VOLTAGE CIRCUIT

[75] Inventor: Naoshi Tokuda, Atsugi, Japan

[73] Assignee: Mitsumi Electric Co., Ltd., Tokyo, Japan

[21] Appl. No.: 08/982,648

[22] Filed: Dec. 2, 1997

[30] Foreign Application Priority Data

Dec. 5, 1996 [JP] Japan ..... 8-325451

[51] Int. Cl.[6] ..... G05F 3/16

[52] U.S. Cl. ..... 323/313; 323/315

[58] Field of Search ..... 323/311, 312, 323/313, 314, 315

[56] References Cited

U.S. PATENT DOCUMENTS 4,769,589 9/1988 Rosenthal ..... 323/313
5,266,885 11/1993 Brambilla et al. ..... 323/313
5,349,286 9/1994 Marshall et al. ..... 323/315
5,373,226 12/1994 Kimura ..... 323/313
5,621,308 4/1997 Kadanka et al. ..... 323/315
5,684,394 11/1997 Marshall ..... 323/315
5,696,440 12/1997 Harada ..... 323/315
5,798,637 8/1998 Kim et al. ..... 323/313

*Primary Examiner*—Jeffrey Sterrett
*Attorney, Agent, or Firm*—Ladas & Parry

[57] ABSTRACT

A constant-current generating circuit, a power-source voltage being applied thereto, generates a constant current. A voltage generating circuit element is connected between the constant-current generating circuit and a fixed voltage point, is supplied with the constant current which is generated by the constant-current generating circuit, and generates a constant voltage. A control circuit detects the current generated by the constant-current generating circuit, and, using the detected current, controls the constant-current generating circuit so that the current to be supplied to the voltage generating circuit element is the constant current.

3 Claims, 5 Drawing Sheets

LOW POWER CONSUMPTION CONSTANT-VOLTAGE CIRCUIT

BACKGROUND OF THE INVENTION

1. Field of the Invention

The present invention relates to a constant-voltage circuit, and, in particular, to a constant-voltage circuit which generates a constant voltage from a power-source voltage.

2. Description of the Related Art

FIG. 1 shows an example of a circuit arrangement in the related art.

A constant-voltage circuit 11 in the related art includes a reference voltage generating circuit 12, a voltage detecting circuit 13, a comparing circuit 14, and a transistor Q11. The reference voltage generating circuit 12 generates a reference voltage Vref from a power-source voltage Vcc. The voltage detecting circuit 13 detects a detected voltage Vs in accordance with a constant output voltage Vout. The comparing circuit 14 compares the reference voltage Vref generated by the reference voltage generating circuit 12 and the detected voltage Vs detected by the voltage detecting circuit 13 with one another. The transistor Q11 draws current into the ground from an output terminal Tout in accordance with the comparison result of the comparing circuit 14.

The power-source voltage Vcc is lowered through a resistor R11 by a voltage drop and supplied to the reference voltage generating circuit 12, voltage detecting circuit 13, comparing circuit 14 and transistor Q11.

The reference voltage generating circuit 12 is connected between the resistor R11 and the ground GND,and includes a resistor R12 and a Zener diode Dz which are connected in series. The reference voltage Vref, which is the Zener voltage of the Zener diode Dz, is output from the connection point Pref between the resistor R12 and Zener diode Dz.

The voltage detecting circuit 13 is connected between the resistor R11 and the ground GND, and includes resistors R13 and R14 which are connected in series. The voltage, obtained as a result of the power-source voltage Vcc being lowered by the voltage drop, is divided, and, thus, the detected voltage Vs is output from the connection point Pvs between the resistors R13 and R14.

The reference voltage Vref generated by the reference voltage generating circuit 12 is supplied to the inverting terminal (−) of the comparing circuit 14, and the detected voltage Vs detected by the voltage detecting circuit 13 is supplied to the non-inverting terminal (+) of the comparing circuit 14. The comparing circuit 14 outputs the differential voltage (Vs−Vref) between the detected voltage Vs and the reference voltage Vref.

The output voltage of the comparing circuit 14 is supplied to the base of the transistor Q11. The transistor Q11 is an NPN transistor, the collector thereof being connected to the connection point between the resistor R11 and the output terminal Tout, and the emitter thereof being grounded.

The transistor Q11 increases its emitter current as a result of a rise of the output voltage of the comparing circuit 14. As a result, the current supplied to the output terminal Tout decreases. The transistor Q11 decreases its emitter current as a result of a fall of the output voltage of the comparing circuit 14. As a result, the current supplied to the output terminal Tout increases.

For example, when the power-source voltage Vcc rises, the output voltage Vout rises, and the detected voltage Vs detected by the voltage detecting circuit 13 also rises. As a result of the rise of the detected voltage Vs, the output voltage of the comparing circuit 14, which is the differential voltage (Vs−Vref) between the detected voltage Vs and the reference voltage Vref, thus rises.

As a result the rise of the differential voltage (Vs−Vref) of the comparing circuit 14, the base voltage of the transistor Q11 rises. Because the transistor Q11 is the NPN transistor, as a result of the rise of its base voltage, its emitter current increases, and thereby, the current drawn through the transistor Q11 into the ground GND increases. As a result of the increase of the current drawn through the transistor Q11 into the ground GND, the current which is supplied to a load (not shown in the figure) decreases. Thereby, the output voltage Vout falls.

By the above-described operations, the output voltage Vout is maintained to be constant.

When the power-source voltage Vcc falls, the output voltage Vout falls, and the detected voltage Vs detected by the voltage detecting circuit 13 also falls. As a result of the fall of the detected voltage Vs, the output voltage of the comparing circuit 14, which is the differential voltage (Vs−Vref) between the detected voltage Vs and the reference voltage Vref, thus falls.

As a result of the fall of the differential voltage (Vs−Vref) of the comparing circuit 14, the base voltage of the transistor Q11 falls. Because the transistor Q11 is the NPN transistor, as a result of the fall of its base voltage, its emitter current decreases, and thereby, the current drawn through the transistor Q11 into the ground GND decreases. As a result of the decrease of the current drawn through the transistor Q11 into the ground GND, the current which is supplied to a load (not shown in the figure) increases. Thereby, the output voltage Vout rises.

By the above-described operations, the output voltage Vout is maintained to be constant.

However, in the constant-voltage circuit in the related art, energy consumption occurs as a result of the current flowing through the Zener diode which generates the reference voltage, resistors which are used for detecting the output voltage, the comparing circuit which compares the reference voltage and the output voltage with one another, and the output controlling transistor Q11 which controls the output voltage as a result of bypassing the current in accordance with the output voltage of the comparing circuit.

Further, in the constant-voltage circuit in the related art, when the output voltage rises, the emitter current of the transistor increases. Thereby, the current supplied to the output terminal Tout is reduced. Thus, the output voltage Vout is maintained to be constant. Accordingly, as shown in FIG. 2, when the power-source voltage rises, the current (useless current) directly flowing to the ground GND increases. Thus, it is difficult to reduce current consumption.

For example, when the constant output voltage 1 V is obtained, approximately 1 $\mu$A is consumed in the Zener diode, approximately 0.5 $\mu$A is consumed in the resistors and comparing circuit, approximately 0.5 $\mu$A is consumed in the output controlling transistor Q11. Thus, a total of 2 $\mu$A is uselessly consumed.

SUMMARY OF THE INVENTION

The present invention has been devised in consideration of the above-mentioned points. An object of the present invention is to provide a constant-voltage circuit which can be driven with low current consumption.

The present invention comprises:

a constant-current generating means, to which a power-source voltage is applied, for generating a constant current;

a voltage generating means, which is connected between the constant-current generating means and a fixed voltage point and is supplied with the constant current which is generated by the constant-current generating means, for generating a constant voltage; and a control means for detecting the constant current generated by the constant-current generating means, and, using the detected constant current, controlling the constant-current generating means so that the constant current to be supplied to the voltage generating means is constant.

In the arrangement, the control means controls the constant current generated by the constant-current generating means, and thus, controls the current supplied to the voltage generating means. Thus, the constant voltage is generated by the voltage generating means. Because the constant current is always supplied to the voltage generating means for generating the constant voltage, even if the power source voltage increases, the current flowing through the voltage generating means is the constant current. Accordingly, it can be prevented that the useless current increases.

Other objects and further features of the present invention will become more apparent from the following detailed description when read in conjunction with the accompanying drawings.

DETAILED DESCRIPTION OF THE PREFERRED EMBODIMENT

Figure 1:
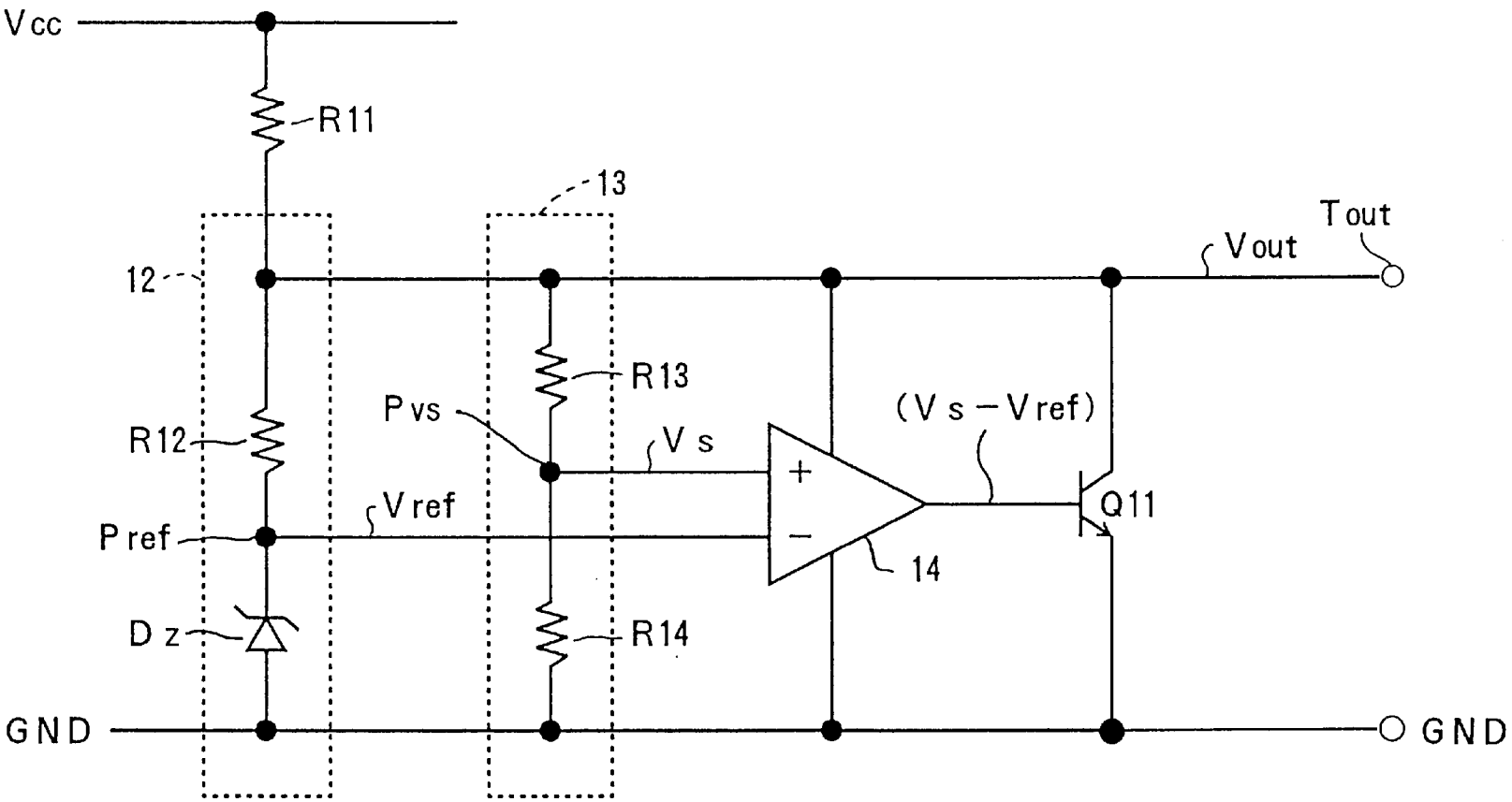
FIG. 1 (PRIOR ART)
FIG. 1 shows a circuit arrangement of one example of the related art.
Figure 2:
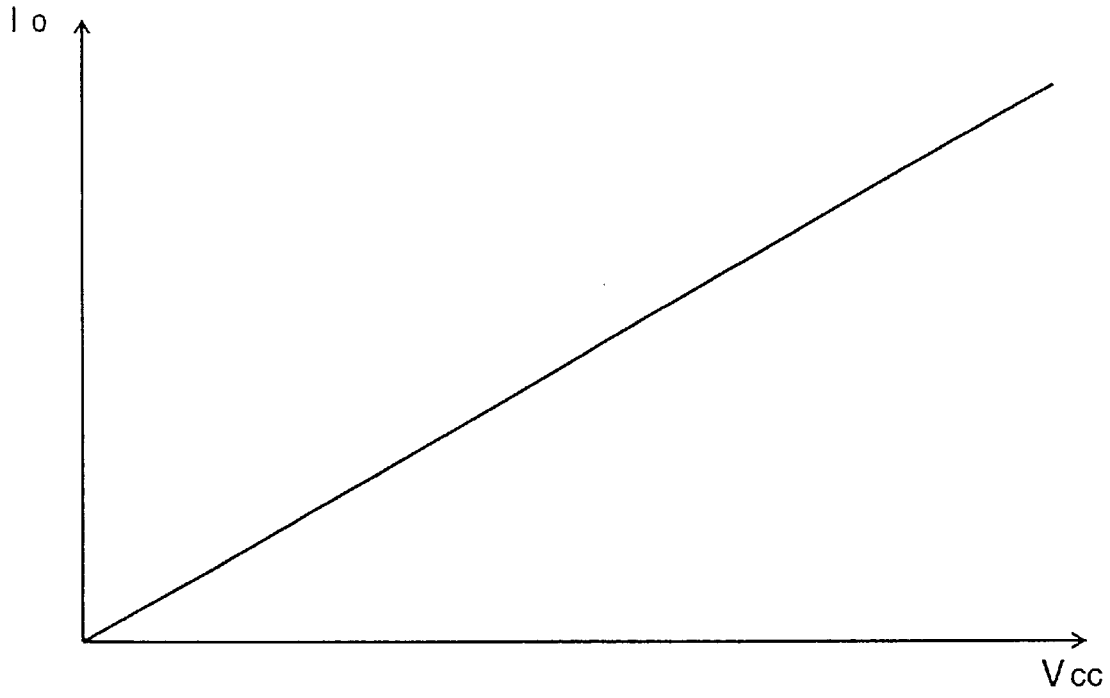
FIG. 2 (PRIOR ART)
FIG. 2 shows a characteristic graph of useless current with respect to power-source voltage in the example of the related art.
Figure 3:
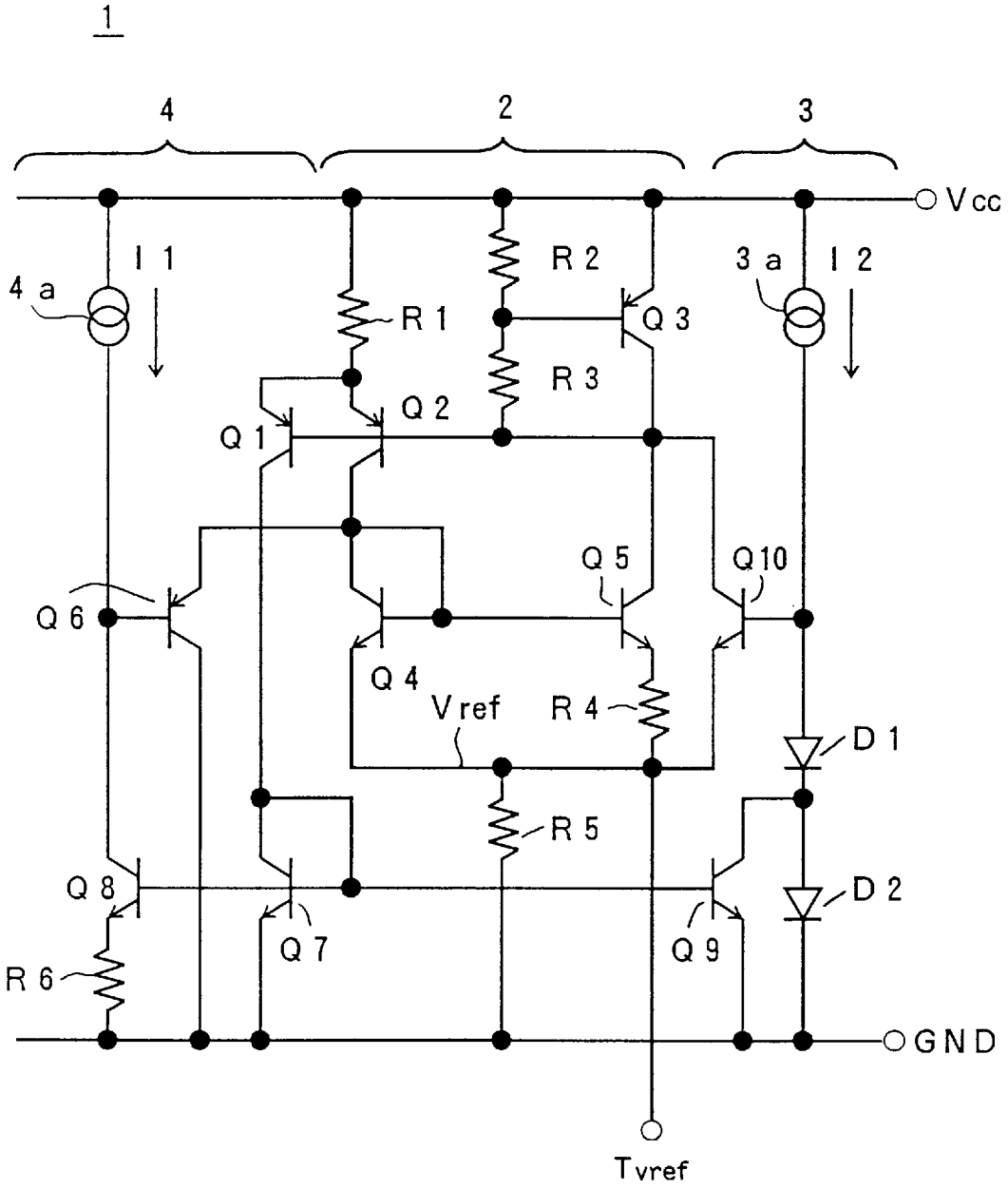
FIG. 3 shows a circuit arrangement of one embodiment of the present invention.

FIG. 3 shows a circuit arrangement of one embodiment of the present invention.

A constant-voltage circuit 1 in the embodiment includes a reference voltage circuit portion 2, a starting-up circuit portion 3, and a control circuit portion 4. The reference voltage circuit portion 2 generates a reference voltage Vref from a power-source voltage Vcc. The starting-up circuit portion 3 starts up the reference voltage circuit portion 2. The control circuit portion 4 controls the reference voltage Vref which is generated by the reference voltage portion 2.

The reference voltage circuit portion 2 includes resistors R1, R2, R3, R4, R5, PNP transistors Q2, Q3, and NPN transistors Q4, Q5. The reference voltage circuit portion 2 generates the reference voltage Vref which is temperature-compensated in accordance with the power-source voltage Vcc. The resistors R1, R2, R3 and R4 act as a first resistor, a second resistor, a third resistor and a fourth resistor, respectively. The resistor R5 acts as a constant-voltage generating means.

Further, the transistors Q2, Q3, Q4 and Q5 act as a first transistor, a second transistor, a third transistor and a fourth transistor, respectively.

The starting-up circuit portion 3 includes a constant-current source 3*a*, NPN transistors Q9, Q10, and diodes D1, D2. The starting-up circuit portion 3 draws current from the reference voltage circuit portion 2 and the control circuit portion 4, and starts up the reference voltage circuit portion 2 and the control circuit portion 4.

The control circuit portion 4 includes a constant-current source 4*a*, a resistor R6, and PNP transistors Q1, Q6, Q7, Q8. The control circuit portion 4 performs control in accordance with the power-source voltage Vcc so that current to be supplied to the resistor R5 of the reference voltage circuit portion 2 is constant. The control circuit portion 4 acts as control means. The transistors Q1, Q7, Q8 and Q6 act as a fifth transistor, a sixth transistor, a seventh transistor and an eighth transistor, respectively.

Operations of the circuit will now be described.

When the power-source voltage Vcc is applied, by the constant-current source 3*a* of the starting-up circuit portion 3 and the constant current source 4*a* of the control circuit portion 4, constant currents I2 and I1 flow through the starting-up circuit portion 3 and the control circuit portion 4, respectively. As a result of the constant current I2 flowing through the starting-up circuit portion 3, the constant current I2 is supplied to the diodes D1 and D2. Thereby, the base voltage of the transistor Q10 rises.

Because the transistor Q10 is the NPN transistor, as a result of the rise of the base voltage, the transistor Q10 turns on. As a result of the transistor Q10 turning on, the transistor Q10 draws current out from the base of each of the transistors Q1 and Q2. Because the transistors Q1 and Q2 are the PNP transistors, each of the transistors Q1 and Q2 turns on as a result of current being drawn out from the bases thereof.

As a result of each of the transistors Q1 and Q2 turning on, current is supplied to the collector and the base of each of the transistors Q4 and Q7. Because the transistors Q4 and Q7 are the NPN transistors, each of the transistors Q4 and Q7 turns on as a result of the current being supplied to the base of each of the transistors Q4 and Q7.

The collector and base of the transistor Q4 are connected to the base of the transistor Q5, and the transistors Q4 and Q5 form a current-mirror circuit. Thereby, as a result of the transistor Q4 turning on, the transistor Q5 also turns on.

The emitter of the transistor Q4 is connected to the resistor R5, and, as a result of the transistor Q4 turning on, current is supplied to the resistor R5. Further, the emitter of the transistor Q5 is connected to the resistor R5 via the resistor R4, and the transistor Q5 supplies current to the resistor R5.

As a result of the current being supplied to the resistor R5, the reference voltage Vref appears across the resistor R5. The reference voltage Vref is output from a reference voltage output terminal Tvref.

Further, the collector and the base of the transistor Q7 are connected to the bases of the transistors Q8 and Q9. Thus, a current-mirror circuit is formed by the transistors Q7 and Q8, and a current-mirror circuit is formed by the transistors Q7 and Q9. Accordingly, as a result of the transistor Q7 turning on, each of the transistors Q8 and Q9 turns on. The emitter of the transistor Q8 is grounded via the resistor R6, and the collector of the transistor Q8 is connected to the connection point between the constant-current source 4*a* and the base of the transistor Q6. Accordingly, as a result of the transistor Q8 turning on, current is drawn out from the base of the transistor Q6. Because the transistor Q6 is the PNP transistor, as a result of the current being drawn out from the base, the transistor Q6 turns on.

Further, the collector and emitter of the transistor Q9 are connected to the two ends of the diode D2, respectively. The transistor Q9 turns on as a result of the transistor Q7 turning on. As a result, the base voltage of the transistor Q10 falls, and, thereby, the transistor Q10 turns off. Thus, the reference voltage circuit portion 2 and the control circuit portion 4 are started up.

Although the transistor Q10 has turned off as mentioned above, the transistor Q5 is turned on as mentioned above. As a result, the transistor Q5 draws current from the base of each of the transistors Q1 and Q2. Accordingly, the on state of each of the transistors Q1 and Q2 is maintained.

When, for example, the power-source voltage Vcc rises, the collector current of each of the transistors Q4 and Q5 increases. As a result of the increase of the collector current of each of the transistors Q4 and Q5, the current supplied to the resistor R5 increases. As a result, the reference voltage Vref rises.

At this time, the voltage of the connection point between the resistors R2 and R3 rises. Thereby, the collector current of the transistor Q3 decreases. As a result of the decrease of the collector current of the transistor Q3, the base voltage of each of the transistors Q1 and Q2 falls.

As a result of the fall of the base voltage of the transistor Q1, the collector current of the transistor Q1 increases. As a result of the increase of the collector current of the transistor Q1, the current supplied to the base of the transistor Q7 increases. As a result, the collector current of the transistor Q7 increases, and also, the collector current of the transistor Q8 increases. As a result, the current drawn out from the base of the transistor Q6 increases. As a result of the increase of the current drawn out from the base, the emitter current of the transistor Q6 increases. As a result of the increase of the emitter current of the transistor Q6, the current supplied to the base of each of the transistor Q4 and Q5 decreases. As a result, the emitter current of each of the transistors Q4 and Q5 decreases. Thereby, the current supplied to the resistor R5 decreases, and thus, the reference voltage Vref falls.

By the above-described operations, the reference voltage Vref is maintained to be a predetermined level (for example, 1 V).

When the power-source voltage Vcc falls and the collector current of each of the transistors Q4 and Q5 decreases, the current supplied to the resistor R5 decreases and the reference voltage Vref falls. At this time, the voltage of the connection point between the resistors R2 and R3 falls. Thereby, the collector current of the transistor Q3 increases.

As a result of the increase of the collector current of the transistor Q3, the base voltage of each of the transistors Q1 and Q2 rises. As a result of rise of the base voltage of the transistor Q1, the collector current of the transistor Q1 decreases. As a result of the decrease of the collector current of the transistor Q1, the current supplied to the base of the transistor Q7 decreases.

As a result of the decrease of the current supplied to the base of the transistor Q7, the collector current of the transistor Q7 decreases, and also, the collector current of the transistor Q8 decreases. As a result, the current drawn out from the base of the transistor Q6 decreases. As a result of the decrease of the current drawn out from the base, the emitter current of the transistor Q6 decreases. As a result of the decrease of the emitter current of the transistor Q6, the current supplied to the base of each of the transistors Q4 and Q5 increases. As a result, the emitter current of each of the transistors Q4 and Q5 increases. Thereby, the current supplied to the resistor R5 increases, and thus, the reference voltage Vref rises.

By the above-described operations, the reference voltage Vref is maintained to be a predetermined level (for example, 1 V).

In the above-described constant-voltage circuit 1, all the constant current generated through the resistors R1, R2, R3 and R4 and the transistors Q2, Q3, Q4 and Q5 of the reference voltage circuit portion 2 is supplied to the resistor R5 which is provided for generating the reference voltage Vref. Thereby, the reference voltage Vref is generated, and the control of the reference voltage Vref is performed by controlling the current to be supplied to the resistor R5 to be constant. Accordingly, the current flowing to the ground can be maintained to be constant. Thus, useless current can be prevented from increasing.

Figure 4:
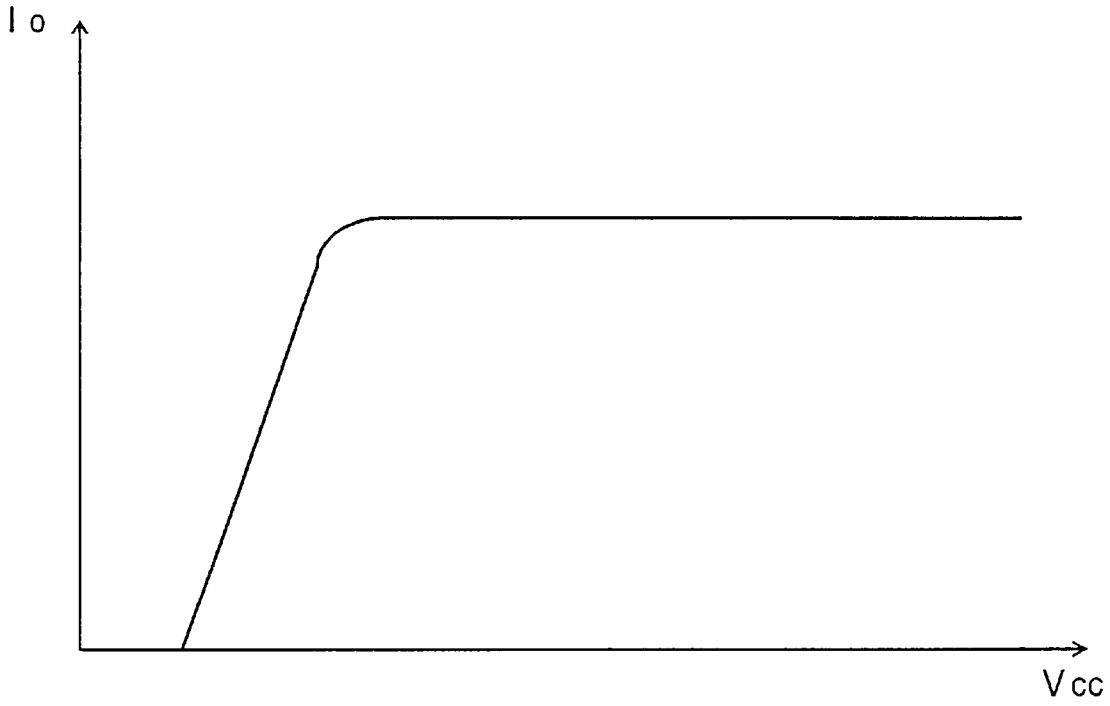
FIG. 4 shows a characteristic graph of useless current with respect to power-source voltage in the embodiment of the present invention.

FIG. 4 shows characteristics of useless current with respect to the power-source voltage Vcc in the embodiment of the present invention.

As shown in FIG. 4, in the embodiment, because the control is performed so that the current flowing through the resistor R5 is constant, although the power-source voltage Vcc rises, the useless current is maintained to be constant. Thus, the useless current can be prevented from increasing.

Further, in the reference voltage circuit portion 2, temperature compensation is performed.

A temperature compensation operation of the reference voltage circuit portion 2 will now be described with reference to a figure.

Figure 5:
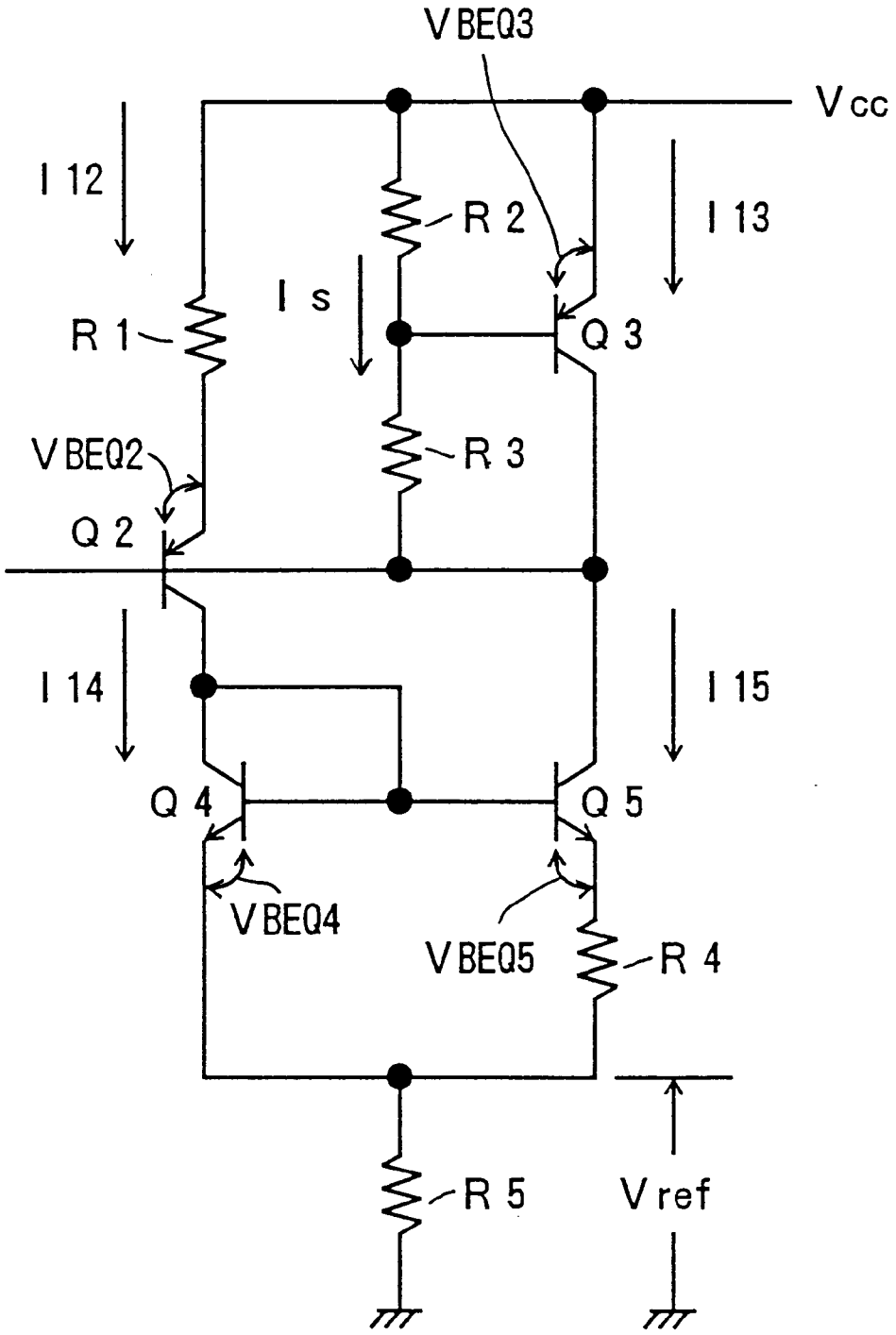
FIG. 5 shows a circuit arrangement of a reference voltage circuit portion in the embodiment of the present invention.

FIG. 5 shows a circuit arrangement of the reference voltage circuit portion of the embodiment of the present invention.

In FIG. 5, Is represents the current flowing through the resistor R2 and R3 from the power source voltage Vcc. I12 represents the emitter current of the transistor Q2. I13 represents the emitter current of the transistor Q3. I14 represents the collector current of the transistor Q4. I15 represents the collector current of the transistor Q5. Vref represents the reference voltage appearing across the resistor R5.

In FIG. 5, the currents I14 and I15 are supplied to the resistor R5 from the transistors Q4 and Q5. Accordingly, the reference voltage Vref appearing across the resistor R5 is expressed as follows:

$$Vref=R5\cdot(I14+I15) \tag{1}$$

VBEQ2 represents the voltage between the base and the emitter of the transistor Q2. VBEQ3 represents the voltage between the base and the emitter of the transistor Q3. When the circuit including the transistors Q2, Q3 and the resistors R1, R2, R3 is considered, the following equation holds:

$$VBEQ2+R1\cdot I12=VBEQ3+(R3/R2)\ VBEQ3 \tag{2}$$

From the equation (2), the voltage VR1=R1·I12 is expressed as follows:

$$VR1=R1\cdot I12=VBEQ3-VBEQ2+(R3/R2)\ VBEQ3 \tag{3}$$

Generally, the voltage VBE between the base and the emitter of a transistor is expressed by the following equation:

$$VBE=\frac{kT}{q}\ln\left(\frac{I}{A}\right) \tag{4}$$

where k represents Boltzmann's constant, T represents the absolute ambient temperature, q represents the electronic charge, A represents the emitter junction area, and I represents the emitter current.

When the equation (3) is rewritten using the equation (4), the equation (3) can be expressed as follows:

$$VR1 = R1 \cdot I12 = \frac{kT}{q}\ln\left(\frac{I13}{A3}\right) - \frac{kT}{q}\ln\left(\frac{I12}{A2}\right) + \frac{R3}{R2}VBEQ3 = \frac{kT}{q}\ln\left(\frac{I13}{I12}\cdot\frac{A2}{A3}\right) + \left(\frac{R3}{R2}\right)VBEQ3 \quad (5)$$

where A2 represents the emitter junction area of the transistor Q2, and A3represents the emitter junction area of the transistor Q3.

Further, VBEQ4 represents the voltage between the base and the emitter of the transistor Q4. VBEQ5 represents the voltage between the base and the emitter of the transistor Q5. When the circuit including the transistors Q4, Q5 and the resistor R4 is considered, the following equation holds:

$$VBEQ4=VBEQ5+I15\cdot R4 \quad (6)$$

From the equation (6), the voltage VR4=I15·R4 appearing across the resistor R4 is expressed by the following equation:

$$VR4=I15\cdot R4=VBEQ4-VBEQ5 \quad (7)$$

When the equation (7) is rewritten using the equation (4), VR4 can be expressed as follows:

$$VR4 = R4 \cdot I15 = \frac{kT}{q}\ln\left(\frac{I14}{A4}\right) - \frac{kT}{q}\ln\left(\frac{I15}{A5}\right) = \frac{kT}{q}\ln\left(\frac{I14}{I15}\cdot\frac{A5}{A4}\right) \quad (8)$$

where A4 represents the emitter junction area of the transistor Q4, and A5represents the emitter junction area of the transistor Q5.

In the equation (8), when it is considered that the current amplification $h_{FE}$ of each of the transistors Q2 and Q4 is sufficiently large, I12=I14.

Accordingly, the equation (8) becomes the following equation (9):

$$VR4 = R4 \cdot I15 = \frac{kT}{q}\ln\left(\frac{I12}{I15}\cdot\frac{A5}{A4}\right) \quad (9)$$

Further, the equation (1), Vref=R5·(I14+I15) can be expressed as follows:

$$Vref=R5\cdot(I12+I15) \quad (10).$$

From the equation (5), the current I12 can be expressed as follows:

$$I12 = \frac{1}{R1}\left\{\frac{kT}{q}\ln\left(\frac{I13}{I12}\cdot\frac{A2}{A3}\right) + \left(\frac{R3}{R2}VBEQ3\right)\right\} \quad (11)$$

Further, from the equation (9), the current I15 can be expressed as follows:

$$I15 = \frac{1}{R4}\left\{\frac{kT}{q}\ln\left(\frac{I12}{I15}\cdot\frac{A5}{A4}\right)\right\} \quad (12)$$

When the equation (10) is rewritten using the equations (11) and (12), the reference voltage Vref can be expressed as follows:

$$\begin{aligned} Vref &= R5\times\left[\frac{1}{R1}\left\{\frac{kT}{q}\ln\left(\frac{I13}{I12}\cdot\frac{A2}{A3}\right) + \frac{R3}{R2}VBEQ3\right\} + \frac{1}{R4}\left\{\frac{kT}{q}\ln\left(\frac{I12}{I15}\cdot\frac{A5}{A4}\right)\right\}\right] \\ &= \frac{R5}{R1}\cdot\frac{kT}{q}\ln\left(\frac{I13}{I12}\cdot\frac{A2}{A3}\right) + \frac{R5}{R1}\cdot\frac{R3}{R2}VBEQ3 + \frac{R5}{R4}\cdot\frac{kT}{q}\ln\left(\frac{I12}{I15}\cdot\frac{A5}{A4}\right) \\ &= \frac{R5}{R1}\cdot\frac{kT}{q}\ln\left(\frac{I13}{I12}\cdot\frac{A2}{A3}\right) + \frac{R5}{R4}\cdot\frac{kT}{q}\ln\left(\frac{I12}{I15}\cdot\frac{A5}{A4}\right) + \frac{R5}{R1}\cdot\frac{R3}{R2}VBEQ3 \end{aligned} \quad (13)$$

When the equation (13) is differentiated by the temperature T, the following equation (14) is obtained:

$$\frac{\Delta Vref}{\Delta T} = \left\{\frac{R5}{R1}\cdot\frac{k}{q}\ln\left(\frac{I13}{I12}\cdot\frac{A2}{A3}\right) + \frac{R5}{R4}\cdot\frac{k}{q}\ln\left(\frac{I12}{I15}\cdot\frac{A5}{A4}\right)\right\} + \frac{R5}{R1}\cdot\frac{R3}{R2}\cdot\frac{\partial VBEQ3}{\partial T} \quad (14)$$

In the equation (14), the second term $$\frac{R5}{R1}\cdot\frac{R3}{R2}\cdot\frac{\partial VBEQ3}{\partial T}$$

is a negative value.

Accordingly, in the first term $$\left\{\frac{R5}{R1}\cdot\frac{k}{q}\ln\left(\frac{I13}{I12}\cdot\frac{A2}{A3}\right) + \frac{R5}{R4}\cdot\frac{k}{q}\ln\left(\frac{I12}{I15}\cdot\frac{A5}{A4}\right)\right\}$$

the resistances of the resistors R1, R4, R5, and the junction areas A2, A3, A4, A5 of the transistors Q2, Q3, Q4, Q5 are appropriately set so that the equation (14) is set to zero.

Thereby, it can be prevented that change of the temperature causes the reference voltage Vref to change.

In the embodiment, the constant current generated by the resistors R1, R2, R3, R4 and the transistors Q2, Q3, Q4, Q5 is supplied to the resistor R5, and the reference voltage Vref is generated using the voltage drop in the resistor R5. Thereby, the useless current in the reference voltage circuit portion 2 can be reduced.

Further, in the starting up circuit portion 3 and control circuit portion 4, the constant-current sources supply the minimum necessary current and the portions are driven, respectively. Accordingly, the useless current can be reduced to the minimum necessary amount.

Further, temperature compensation is performed in the reference voltage circuit portion 2, and thus, it can be prevented that change of the temperature causes the reference voltage Vref to change.

Further, the present invention is not limited to the above-described embodiments, and variations and modifications may be made without departing from the scope of the present invention.

What is claimed is:

1. A constant-voltage circuit comprising:

a first resistor, the power-source voltage being applied to one end thereof;

a first transistor, the emitter thereof being connected with the other end of said first resistor;

a second transistor, the junction type thereof being the same as that of said first transistor, the power-source voltage being applied to the emitter of said second transistor, the collector of said second transistor being connected with the base of said first transistor;

a second resistor, connected between the emitter and base of said second transistor;

a third resistor, connected between the base and collector of said second transistor;

a third transistor, the junction type thereof being different from that of said first transistor, the collector of said third transistor being connected with the collector of said first transistor, the collector and base of said third transistor being connected with one another, the emitter of said third transistor being connected with a voltage generating means;

a fourth transistor, the junction type thereof being different from that of said first transistor, the collector of said fourth transistor being connected with the collector of said second transistor, the base of said fourth transistor being connected with the base of said third transistor;

a fourth resistor, one end thereof being connected with the emitter of said fourth transistor, and the other end of said fourth resistor being connected to said voltage generating means;

a fifth transistor, the junction type thereof being the same as that of said first transistor, the emitter of said fifth transistor being connected with the connection point between said first resistor and the emitter of said first transistor, the base of said fifth transistor being connected with the base of said first transistor;

a sixth transistor, the junction type thereof being different from that of said fifth transistor, the collector of said sixth transistor being connected with the collector of said fifth transistor, the base and collector of said sixth transistor being connected with one another, and the emitter of said sixth transistor being grounded;

a constant-current source, which is supplied with the power-source voltage, for generating a constant current;

a seventh transistor, the junction type of which is different from that of said fifth transistor, the constant current generated by said constant-current source being supplied to the collector of said seventh transistor, the base thereof being connected with the base of said sixth transistor;

a fifth resistor, one end thereof being connected with the emitter of said seventh transistor and the other end thereof being grounded; and an eighth transistor, the junction type thereof being the same as that of said fifth transistor, the base of said eighth transistor being connected with the connection point between said constant-current source and the collector of said seventh transistor, the emitter of said eighth transistor being connected with the collectors of said first transistor and said third transistor, and the collector of said eighth transistor being grounded.

2. A constant-voltage circuit comprising:

a constant-current generating means, to which a power-source voltage is applied, for generating a constant current;

a voltage generating means, which is connected between said constant-current generating means and a fixed voltage point and is supplied with the constant current which is generated by said constant-current generating means, for generating a constant voltage; and a control means for detecting the current generated by said constant-current generating means, and, using the detected current, controlling said constant-current generating means so that the current to be supplied to said voltage generating means is the constant current;

wherein said constant-current generating means comprises:

a first resistor, the power-source voltage being applied to one end thereof;

a first transistor, the emitter thereof being connected with the other end of said first resistor;

a second transistor, the junction type thereof being the same as that of said first transistor, the power-source voltage being applied to the emitter of said second transistor, the collector of said second transistor being connected with the base of said first transistor;

a second resistor, connected between the emitter and base of said second transistor;

a third resistor, connected between the base and collector of said second transistor;

a third transistor, the junction type thereof being different from that of said first transistor, the collector of said third transistor being connected with the collector of said first transistor, the collector and base of said third transistor being connected with one another, the emitter of said third transistor being connected with said voltage generating means;

a fourth transistor, the junction type thereof being different from that of said first transistor, the collector of said fourth transistor being connected with the collector of said second transistor, the base of said fourth transistor being connected with the base of said third transistor; and a fourth resistor, one end thereof being connected with the emitter of said fourth transistor, and the other end of said fourth resistor being connected to said voltage generating means.

3. The constant-voltage circuit, according to claim 2, wherein said control means comprises:

a fifth transistor, the junction type thereof being the same as that of said first transistor, the emitter of said fifth transistor being connected with the connection point between said first resistor and the emitter of said first transistor, the base of said fifth transistor being connected with the base of said first transistor;

a sixth transistor, the junction type thereof being different from that of said fifth transistor, the collector of said sixth transistor being connected with the collector of said fifth transistor, the base and collector of said sixth transistor being connected with one another, and the emitter of said sixth transistor being grounded;

a constant-current source, which is supplied with the power-source voltage, for generating a constant current;

a seventh transistor, the junction type of which is different from that of said fifth transistor, the constant current generated by said constant-current source being supplied to the collector of said seventh transistor, the base thereof being connected with the base of said sixth transistor;

a fifth resistor, one end thereof being connected with the emitter of said seventh transistor and the other end thereof being grounded; and an eighth transistor, the junction type thereof being the same as that of said fifth transistor, the base of said eighth transistor being connected with the connection point between said constant-current source and the collector of said seventh transistor, the emitter of said eighth transistor being connected with the collectors of said first transistor and said third transistor, and the collector of said eighth transistor being grounded.

* * * * *

UNITED STATES PATENT AND TRADEMARK OFFICE

CERTIFICATE OF CORRECTION

PATENT NO: 5,994,887

DATED: November 30, 1999

INVENTOR(S): Naoshi TOKUDA

It is certified that error appears in the above-identified patent and that said Letters Patent is hereby corrected as shown below:

Col. 9, line 5 (claim 1) before "power-source" delete "the" and insert --a--.

Signed and Sealed this

Thirteenth Day of February, 2001

*Attest:*

*Attesting Officer*

NICHOLAS P. GODICI

*Acting Director of the United States Patent and Trademark Office*